US008109820B2

(12) United States Patent
Nagel et al.

(10) Patent No.: US 8,109,820 B2
(45) Date of Patent: Feb. 7, 2012

(54) METHODS AND APPARATUS FOR CHESS INSTRUCTION

(76) Inventors: Ralph Nagel, Berkeley, CA (US); Joseph Nagel, Berkeley, CA (US)

( * ) Notice: Subject to any disclaimer, the term of this patent is extended or adjusted under 35 U.S.C. 154(b) by 703 days.

(21) Appl. No.: 11/805,630

(22) Filed: May 24, 2007

(65) Prior Publication Data

US 2007/0287518 A1 Dec. 13, 2007

Related U.S. Application Data

(60) Provisional application No. 60/808,438, filed on May 24, 2006, provisional application No. 60/808,675, filed on May 26, 2006.

(51) Int. Cl.
*A63F 3/02* (2006.01)
*G06F 19/24* (2006.01)

(52) U.S. Cl. ..... 463/14; 463/9; 707/804

(58) Field of Classification Search ..... 463/14–15, 463/40–42, 9; 434/128; 707/796, 797, 804
See application file for complete search history.

(56) References Cited

U.S. PATENT DOCUMENTS 3,339,289 A * 9/1967 Arkin ..... 434/128
5,098,106 A * 3/1992 Hegener ..... 273/238
5,678,001 A 10/1997 Nagel
5,918,035 A * 6/1999 Van Praet et al. ..... 703/22
6,159,014 A * 12/2000 Jenkins et al. ..... 434/169
6,213,873 B1 * 4/2001 Gasper et al. ..... 463/14
6,231,441 B1 * 5/2001 Golad ..... 463/9
6,725,238 B1 * 4/2004 Auvenshine ..... 1/1
7,294,058 B1 * 11/2007 Slomiany et al. ..... 463/31
2001/0049297 A1 * 12/2001 Hibscher et al. ..... 463/9
2003/0109310 A1 * 6/2003 Heaton et al. ..... 463/42
2007/0259707 A1 * 11/2007 Kang ..... 463/16

OTHER PUBLICATIONS

Fritz 8. Amazon.com Product Listing [online]. Apr. 11, 2003 [retrieved on Jan. 25, 2011] Retrieved from the Internet: <http://www.amazon.com/Viva-Media-Fritz-8/dp/B0000959L9/ref=sr_1_2?s=software&ie=UTF8&qid=1296050049&sr=1-2>.*

ChessBase Support [online]. Mar. 12, 2000 [retrieved on Jan. 20, 2011]. Retrieved from the Internet: <http://www.chessbase.com/support/support.asp?pid=89>.*

Lopez, S. Engine Tricks. ChessBase Workshop [online]. Jun. 14, 2004 [retrieved on Jan. 20, 2011]. Retrieved from the Internet: <http://www.chessbase.com/workshop2.asp?id=1699>.*

ChessBase Support [online]. Oct. 11, 1998 [retrieved on Jan. 20, 2011]. Retrieved from the Internet: <http://www.chessbase.com/support/support.asp?pid=15>.*

Lopez, S. Chessbase 9's Material Balance Display. ChessBase News [online]. Feb. 15, 2005 [retrieved on Jan. 25, 2011]. Retrieved from the Internet: <http://www.chessbase.com/newsdetail.asp?newsid=2187>.*

Lopez, S. Electronic T-Notes [online]. Feb. 24, 2002 [retrieved on Jan. 25, 2011]. Retrieved from the Internet: <http://www.chessbase.com/support/support.asp?pid=199>.*

(Continued)

*Primary Examiner* — Dmitry Suhol
*Assistant Examiner* — Carl V Larsen
(74) *Attorney, Agent, or Firm* — H. Michael Brucker

(57) ABSTRACT

Methods and apparatus, including software, for creating a database of information based on one or more chess game scores, preferably by a chess engine analyzer, from which database instructive puzzles can be constructed for presentation and solution by a player.

7 Claims, 9 Drawing Sheets

OTHER PUBLICATIONS

ChessBase Support [online]. Mar. 19, 2000 [retrieved on Jan. 20, 2011]. Retrieved from the Internet: <http://www.chessbase.com/support/support.asp?pid=90>.*

Lopez, S. Mate Search in Fritz. ChessBase Workshop [online]. Aug. 7, 2004 [retrieved on Jan. 20, 2011]. Retrieved from the Internet: <http://www.chessbase.com/workshop2.asp?id=1833>.*

Kenilworth Chess Club. Middlegame: Tactics and Strategy [online]. Dec. 29, 2011 [retrieved on Jul. 21, 2011] Retrieved from the Internet: <http://web.archive.org/web/20051229012053/http://www.kenilworthchessclub.org/links/middlegame.html>.*

Temposchlucker. The road is harsh buth clear [online]. Sep. 19, 2005 [retrieved on Jul. 21, 2011] Retrieved from the Internet: <http://temposchluckerblogspot.com/2005/09/road-is-harsh-buth-clear.html>.*

Free Merriam-Webster Dictionary. puzzle (noun) [online]. Retrieved on Jul. 21, 2011. Retrieved from the Internet: <http://www.merriam-webster.com/dictionary/puzzle?show=1&t=1310151017>.*

* cited by examiner

PGN Game Record

13a

13

14

[Event "Quick draw McGraw!"]
[Site "http://gameknot.com/chess.pl?bd=2886884"]
[Date "2005.06.10"]
[White "rnagel"]
[Black "indypooper"]
[Result "1/2-1/2"]
[WhiteElo "1426"]
[BlackElo "1225"]
[TimeControl "1/432000"]
[Mode "ICS"]
[Termination "normal"]

1. e4 e5 2. f4 exf4 3. Nf3 Bd6 4. Bc4 Nh6 5. d4 O-O
6. O-O c5 7. d5 Ng4 8. h3 Ne3 9. Bxe3 fxe3 10. Nc3 Bf4
11. Qd3 d6 12. Ne2 Qf6 13. Nxf4 Qxf4 14. Rae1 a6 15. a4 b5
16. axb5 axb5 17. Bxb5 Ba6 18. Bxa6 Nxa6 19. Qxe3 Qxe3+ 20. Rxe3 Rfe8
21. Nd2 Nb4 22. c3 Nxd5 23. Ref3 Nf6 24. g4 Nxe4 25. Nxe4 Rxe4
26. Rf3xf7 Re3 27. Kg2 Re2+ 28. Rf1f2 Rxb2 29. Rxb2 Kxf7 30. Kf3 Re8
31. Rb7+ Re7 32. Rb6 Re6 33. Kf4 d5 34. Rb5 Re4+ 35. Kf5 g6+
36. Kg5 Rc4 37. Rb3 d4 38. cxd4 cxd4 39. Kh6 Rc3 40. Rb4 d3
41. Rd4 Ke6 42. Kxh7 Ke5 43. Rd8 Ke4 44. Kxg6 Ke3 45. Re8+ Kd2
46. g5 Rc4 47. Kh7 Kc3 48. Re3 Kd4 49. Re8 Rc5 50. g6 d2
51. Rd8+ Kc3 52. g7 Rh5+ 53. Kg6 Rxh3 54. g8=Q Rg3+ 55. Kf7 Rxg8
56. Kxg8 Kc2 57. Rxd2+ Kxd2 1/2-1/2

FIG. 4

```
[Event "[R] tan joseph was sequansewn and teddybearlined"]
[Site "http://gameknot.com/chess.pl?bd=6573447"]
[Date "2007.01.31"]
[Round "-"]
[White "rnagel"]
[WhiteElo "1441"]
[Black "jnagel"]
[BlackElo "1140"]
[Result "0-1"]
[Annotator "Crafty v20.13"]
{annotating both black and white moves.}
{using a scoring margin of +0.50 pawns.}
{search time limit is 30.00}

 1.    e4     e5
 2.    f4     f5
 3.   Nc3    Nc6
 4.   Nf3    Nf6
 5.    d3   exf4
 6.  Bxf4    Bc5
        ({12:+0.90} 6. ... Bc5 7. Qd2 d6 8. O-O-O O-O 9. Be2 Bb4 10. Rhf1 Qe7 1
        ({12:+0.29} 6. ... Bb4 7. exf5 O-O 8. Be2 d6 9. O-O Bxf5 10. Qd2 Qe7 11.
 7.   Qd2   fxe4
 8.  Nxe4     d5
        ({12:+5.06} 8. ... d5 9. Nxc5 Qe7+ 10. Qe2 b6 11. Nb3 Bg4 12. Bxc7 Bxf3
        ({12:+1.01} 8. ... Nxe4 9. dxe4 O-O 10. Bc4+ Kh8 11. O-O-O Qe7 12. Bd5
 9.  Nxc5   Qe7+
10.   Be2
        ({13:+1.12} 10. Be2 Qxc5 11. O-O-O Bd7 12. Ne5 Be6 13. d4 Qb6 14. Nxc
        ({13:+4.83} 10. Qe2 Bg4 11. Qxe7+ Nxe7 12. Ne5 O-O 13. h3 Rae8 14. h›

10.   ...   Qxc5

    0-1
```

FIG. 5

N Ranked Moves (searching for both White and Black)

*Instruct the "Game Search Engine" to output N Ranked Moves for each position of the standardized game record file.*

[Event "Quick draw McGraw!"]
[Site "http://gameknot.com/chess.pl?bd=2005.06.10"]
[Date "2005.06.10"]
[Round "?"]
[White "magel"]
[WhiteElo "1426"]
[Black "indypooper"]
[BlackElo "1225"]
[Result "1/2-1/2"]
[Annotator "Crafty v19.19"]
{annotating both black and white moves.}
{using a scoring margin of -0.10 pawns.}
{search time limit is 5:00}

13a

FIG. 6

18 (15g)

< PICKING UP MID-GAME >

50. g6
({14:-7.96} 50. g6 Rh5+ 51. Kg7 d2 52. Rd8+ Rd5 53. Rxd5+ Kxd5 54. Kh6 d1=Q 55. g7 Qc1+ 56. Kg6 Qc8 57. Kg5 Ke5 58. h4 Qf5+ 59. Kh6 Qf4+ $19)
({14:+0.01} 50. Rd8+ Ke3 51. g6 Rh5+ 52. Kg8 Rxh3 53. g7 d2 54. Kf7 Rf3+ 55. Ke8 Rg3 56. Rxd2 Kxd2 57. Kf8 Ke1 58. g8=Q Rxg8+ 59. Kxg8 Kf2 $10)
({14:-4.62} 50. Re1 Rxg5 51. h4 Rg4 52. Rh1 d2 53. h5 Kc3 54. h6 Kc2 55. Rh2 Kc1 56. Rh1+ d1=Q 57. Rxd1+ Kxd1 58. Kh8 $19)
({14:-4.99} 50. Ra8 d2 51. Ra1 Rxg5 52. h4 Rc5 53. Rd1 Kd3 54. h5 Rc1 55. Rxd2+ Kxd2 56. h6 Rg1 57. Kh8 Rh1 $19)

50. ... d2
({12:-0.01} 50. ... d2 51. Rd8+ Kc3 52. g7 Rh5+ 53. Kg8 Rxh3 54. Rc8+ Kb2 55. Rb8+ Kc1 56. Rc8+ Kb1 57. Rb8+ Kc1 $10)
({12:-7.42} 50. ... Rh5+ 51. Kg7 d2 52. Rd8+ Rd5 53. Rxd5+ Kxd5 54. Kh6 d1=Q 55. g7 Qd2+ 56. Kg6 Qd3+ 57. Kf7 Qf3+ 58. Kg6 Qd3+ $19)
({12:+2.15} 50. ... Kc3 51. g7 d2 52. Re3+ Kd4 53. g8=Q Rh5+ 54. Kg6 d1=Q 55. Qd8+ Rd5 56. Qb6+ Kc4 57. Re4+ Kc3 58. Qc6+ Kb3 $18)

51. Rd8+
({15:+0.01} 51. Rd8+ Ke3 52. Kh6 Rc4 53. g7 Rh4+ 54. Kg6 Rxh3 55. g8=Q Rg3+ 56. Kh7 Rxg8 57. Kxg8 Ke2 $10)
({15:+0.01} 51. g7 Rh5+ 52. Kg6 Rxh3 53. g8=Q Rg3+ 54. Kh7 Rxg8 55. Rxg8 Kd3 56. Rg6 d1=Q 57. Rd6+ Kc2 58. Rxd1 Kxd1 59. Kg6 Kc1 60. Kh6 $10)
({14:-9.12} 51. Kh6 d1=Q 52. Rd8 Rd5 53. Rxd5 Kxd5 54. g7 Qc1 55. Kh7 Qc2 56. Kh8 Qc3 57. Kh7 Qxh3 58. Kg6 Qg4 59. Kf6 Kd6 60. Kf7 Qe6 $19)

AND ON THROUGH ALL THE MOVES OF THE GAME >

Candidate Puzzle Re-Search (searching for BLACK ONLY)

*For each "Candidate Move", instruct the "Search Engine" to "Re-Search" each position of the Principal Variation of the solution ( the #1 ranked move with its full sequence of top ranked moves ) and output N Ranked Moves for each position in the sequence of moves for that Principal Variation.*

50. g6 Rh5+
({12:-7.34} 50. ... Rh5+ 51. Kg7 d2 52. Rd8+ Rd5 53. Rxd5+ Kxd5 54. Kh6 d1=Q 55. g7 Qd2+ 56. Kg6 Qd3+ 57. Kf7 Qf5+ 58. Ke8 Qe5+ 59. Kf8 Qf6+ $19)
({12:-0.01} 50. ... d2 51. g7 Rh5+ 52. Kg6 Rxh3 53. g8=Q Rg3+ 54. Kh7 Rxg8 55. Rxg8 Ke3 56. Re8+ Kd3 57. Kh8 d1=Q 58. Rd8+ Kc2 59. Rxd1 Kxd1 $10)
({12:+2.07} 50. ... Kc3 51. g7 d2 52. Re3+ Kd4 53. g8=Q Rh5+ 54. Kg6 d1=Q 55. Qe6 Rd5 56. Re4+ Kc5 57. Qc8+ Kb5 58. Qb7+ Ka5 59. Qb4+ Ka6 60. h4 $18)

51. Kg7 d2
({11:-7.34} 51. ... d2 52. Rd8+ Rd5 53. Rxd5+ Kxd5 54. Kh6 d1=Q 55. g7 Qd2+ 56. Kg6 Qd3+ 57. Kf7 Qf5+ 58. Ke8 Qe5+ 59. Kf8 Qf6+ 60. Kg8 Qf5 61. Kh8 Qxh3+ $19)
({11:-0.01} 51. ... Rxh3 52. Kf7 Rf3+ 53. Ke7 d2 54. g7 Re3+ 55. Kf8 Rxe8+ 56. Kxe8 d1=Q 57. g8=Q Qh5+ 58. Kf8 Kc3 59. Qf7 Qxf7+ 60. Kxf7 Kb2 $10)
({11:-0.01} 51. ... Rd5 52. Re1 d2 53. Rd1 Kc3 54. Kf7 Kc2 55. Rxd2+ Kxd2 56. g7 Rd7+ 57. Kf8 Rd8+ 58. Kf7 Rd7+ $10)

52. Rd8+ Rd5
({12:-8.50} 52. ... Rd5 53. Rxd5+ Kxd5 54. Kh6 d1=Q 55. g7 Qc1+ 56. Kh7 Qc2+ 57. Kh8 Qc3 58. Kh7 Qxh3+ 59. Kg6 Qg4+ 60. Kf6 Qe6+ 61. Kg5 Qg8 62. Kg6 $19)
({12:-0.01} 52. ... Ke3 53. Kf7 Rxh3 54. g7 Rf3+ 55. Ke8 Rg3 56. Kf8 Ke2 57. Re8+ Re3 58. Rxe3+ Kxe3 59. g8=Q d1=Q 60. Qh7 Qf1+ 61. Kg8 $10)
({12:-0.01} 52. ... Kc3 53. Kf7 Rxh3 54. g7 Rd3 55. Rc8+ Kd4 56. g8=Q d1=Q 57. Ke8 Qh5+ 58. Kf8 Rd2 59. Qf7 Qxf7+ 60. Kxf7 Kd3 $10)

53. Rxd5+ Kxd5
({14:-9.34} 53. ... Kxd5 54. Kh6 d1=Q 55. g7 Qd2+ 56. Kg6 Qd3+ 57. Kf7 Qf5+ 58. Ke7 Qe6+ 59. Kf8 Qf6+ 60. Kg8 Ke5 61. Kh7 Qf7 62. Kh6 Qe6+ 63. Kg5 $19)
({13:+19.11} 53. ... Ke3 54. h4 Ke2 55. Rxd2+ Kxd2 56. h5 Kc1 57. h6 Kb1 58. h7 Kc1 59. Kf7 Kd1 60. g7 Ke2 61. h8=Q $18)
({13:+19.11} 53. ... Kc3 54. h4 Kc2 55. Rxd2+ Kxd2 56. h5 Ke2 57. h6 Kf3 58. Kf7 Kg4 59. h7 Kf3 60. g7 Ke2 61. h8=Q $18)

54. Kh6 d1=Q
({13:-10.21} 54. ... d1=Q 55. g7 Qd2+ 56. Kg6 Qd3+ 57. Kf6 Qa6+ 58. Kg5 Qe6 59. h4 Ke5 60. h5 Qf6+ 61. Kg4 Qxg7+ 62. Kh3 Qg5 63. h6 Qxh6+ 64. Kg4 Kd4 $19)
({13:-0.01} 54. ... d1=R 55. g7 Rg1 56. Kh7 Ke5 57. g8=Q Rxg8 58. Kxg8 Kf4 59. Kh7 Kg3 60. h4 Kxh4 61. Kg7 $10)
({13:+1.26} 54. ... Ke5 55. g7 d1=Q 56. g8=Q Qd6+ 57. Kh5 Qd1+ 58. Qg4 Qf1 59. Qg5+ Kd6 60. Qd8+ Ke6 61. Qe8+ Kd6 62. Qb8+ Kd5 63. Qb7+ Kd4 64. Qb6+ Ke5 65. Qb8+ Kd5 $16)

55. g7 Qd2+
({12:-10.21} 55. ... Qd2+ 56. Kg6 Qd3+ 57. Kf6 Qa6+ 58. Kg5 Qe6 59. Kh5 Qxh3+ 60. Kg6 Qg4+ 61. Kf7 Qe6+ 62. Kf8 Qf6+ 63. Ke8 Qxg7 64. Kd8 Ke5 65. Ke8 $19)
({12:-9.25} 55. ... Qc1+ 56. Kh7 Qc7 57. Kg6 Qd6+ 58. Kh7 Qe7 59. Kg6 Qe8+ $19)
({12:-9.11} 55. ... Qg1 56. Kh7 Qa7 57. Kh8 Qd4 58. Kh7 Qd3+ 59. Kh6 Qxh3+ 60. Kg6 Qg4+ 61. Kf6 Kd6 62. Kf7 Qe6+ 63. Kf8 Qe7+ 64. Kg8 Ke5 $19)

56. Kg6 Qd3+
({11:-10.21} 56. ... Qd3+ 57. Kf6 Qa6+ 58. Kg5 Qe6 59. h4 Ke5 60. h5 Qf6+ 61. Kg4 Qxg7+ 62. Kh3 Qg5 63. Kh2 Qxh5+ 64. Kg3 Qf5 $19)
({11:-10.21} 56. ... Qc2+ 57. Kf6 Qc6+ 58. Kf5 Qe6+ 59. Kg5 Ke4 60. g8=Q Qxg8+ 61. Kf6 Kf4 62. h4 Qd8+ 63. Kg7 Qxh4 64. Kg8 $19)
({11:-9.32} 56. ... Qg2+ 57. Kf7 Qf3+ 58. Kg6 Qe4+ 59. Kh6 Qc6+ 60. Kg5 Kd4 61. h4 Ke5 62. h5 Qf6+ 63. Kg4 Qxg7+ 64. Kh4 Qf6+ 65. Kg4 Qf4+ 66. Kh3 Qh6 $19)

57. Kf7 Qf3+
({12:-10.21} 57. ... Qf3+ 58. Kg6 Qe4+ 59. Kh6 Qc6+ 60. Kg5 Ke5 61. h4 Qf6+ 62. Kh5 Qf7+ 63. Kg4 Qxg7+ 64. Kh3 Kd4 65. h5 Qg5 66. Kh2 Qxh5+ $19)
({12:-Mat08} 57. ... Qf5+ 58. Ke7 Qe6+ 59. Kf8 Qf6+ 60. Kg8 Qf5 61. h4 Ke6 62. Kh8 Qh5+ 63. Kg8 Qxh4 64. Kf8 Qd8# $19)
({12:-10.21} 57. ... Qh7 58. Kf6 Qh6+ 59. Kf5 Qxh3+ 60. Kg6 Qe6+ 61. Kh7 Qe4+ 62. Kh6 Qg4 63. g8=Q+ Qxg8 64. Kh5 Ke5 65. Kh4 Kd4 $19)

58. Kg6 Qd3+
({11:-10.21} 58. ... Qd3+ 59. Kf6 Qh7 60. Kg5 Qxg7+ 61. Kf4 Qe5+ 62. Kf3 Qh2 63. h4 Qxh4 64. Kg2 Ke5 65. Kg1 $19)
({11:-10.21} 58. ... Qe4+ 59. Kh6 Qe6+ 60. Kg5 Ke5 61. h4 Qf6+ 62. Kh5 Qf7+ 63. Kg4 Qxg7+ 64. Kh3 Kd4 65. Kh2 Qg4 66. Kh1 Qxh4+ $19)
({11:-9.32} 58. ... Qg3+ 59. Kf7 Qf4+ 60. Kg6 Qe4+ 61. Kh6 Qe6+ 62. Kg5 Ke4 63. h4 Ke5 64. h5 Qf6+ 65. Kg4 Qxg7+ 66. Kh4 Qf6+ 67. Kg4 Qf4+ 68. Kh3 Qh6 $19)

FIG. 7

METHODS AND APPARATUS FOR CHESS INSTRUCTION

FIELD OF INVENTION

The present invention relates to the game of chess and, more particularly, to a chess instructional system in which instructional chess puzzles are computer-generated. A chess engine analyzer program residing on a non-transitory computer-readable medium operates with a computer to create a searchable database of information from one or more chess game records to create instructional chess puzzles.

BACKGROUND

One of the most successful and popular computer-driven chess teaching programs is the one described in U.S. Pat. No. 5,678,001, which has been successfully marketed for more than a decade under the brand name Chess Mentor®. Chess Mentor® presents various chess puzzles (problems) to be solved by moving virtual chess pieces on a board on a computer screen. To assist the player and provide a deeper level of instruction, Chess Mentor® provides with each puzzle Hints that help solve the puzzle, Instructions regarding the nature of the puzzle and Commentary on the player's efforts in solving the puzzle. The puzzles, including their Information, Hints, and Commentary, are authored by a person, typically a chess expert, and frequently concentrate on particular aspects of the game. The particular strengths and weaknesses of a particular player are not and cannot be accounted for in the puzzles offered by Chess Mentor®. Thus, while Chess Mentor® has enjoyed well deserved success, it does not approach the level of a live chess coach who can recognize a player's particular strengths and weaknesses and focus attention on those areas where improvement is most needed and often overlooked.

The system of the present invention makes a novel use of known chess engine software to create instructional puzzles (including Information, Hints and Commentary) that are computer-generated and tailored to the play of a particular (user) player.

Since the early days of computers, the ability to play chess has been one of the most popular demonstrations of computing power. As computers have become more powerful and more sophisticated, their ability to play chess at a high level has increased to the point where computer software programs that play chess (referred to herein as "chess engines") are regularly able to dominate human players. There are numerous chess engines that are available to players (some for a fee and some free) such as the popular free chess engine software known by the acronym "CRAFTY".

The fundamental paradigm by which such chess engines operate, however, is the same and has not changed. For every arrangement of chess pieces on a board (the search starting position), the chess engine searches the possible moves available and determines the next move that will have the most favorable result (this move is often referred to as the "top ranked" move and will be so referred to herein) assuming that the opponent counters with top ranked moves. The number of forward moves considered by the engine in arriving at the top ranked move is a function of the search time allotted to the engine. Every legal move considered by the chess engine is given a numerical score reflecting the results of making that move and following that move with the moves that the engine would make from that point forward. The top ranked move and the following chess engine moves are referred to as the "principal variation" or simply "PV". The standardized scoring system recognized throughout the chess world enables different moves from the same starting position to be objectively compared.

In recent years, chess engines have also been used to provide an analysis of a game score (the game notation that records the game moves and allows the game to be replayed exactly) of an actual played game. If a player wants to know how the moves made in a recorded game (either his/hers or someone else's) compare with the moves a computer engine would have made, the game score can be entered into the chess engine using standard chess notation and the engine will create a database that provides a numerical score for each game move and identifies the corresponding top ranked move that the computer would have made from that position and the numerical score for that top ranked move. The numerical score of a move is reflective of the result of making that move followed by the moves (top ranked) that the chess engine would make from that point forward. The engine provides the PV for the top ranked move, as well as the game move. In this way, a player can compare his/her game play (or that of someone else) to that of the chess engine. Chess engine software used to analyze a game, as opposed to only play a game, is referred to herein as a "chess engine analyzer" (program). The database created by a chess engine analyzer as presently known in the art is referred to herein as a "standard comparative game analysis" database ("SCGA database").

The term "database" as used herein refers to a collection of information (data) that exists in digital form for any period of time. The term "table" as used herein refers to a particular collection of data in a database and when a database is said to contain a plurality of such tables, it is to be understood that such tables may or may not exist simultaneously at any given point in time.

With the advent of the Internet, it has become increasingly popular for chess players to meet and play chess matches in cyberspace at various Internet-accessible web sites providing such services. Such web sites typically include the service of maintaining a file of the games scores of all games played by a member player. It is not unusual for an active player to accumulate hundreds of games in the course of a year or so. Accordingly, vast files of game scores accumulate at such web sites and typically are rarely used by anyone, including the players.

The present invention advances the art of computer-aided chess instructional programs by tapping the power of chess engines to create a searchable database from game scores of past played games and create instructional puzzles therefrom as valuable and effective teaching tools that, for the first time, approach the level of sophistication of a live coach.

BRIEF DESCRIPTION OF THE PRESENT INVENTION

The present invention comprises a database of information created by a chess engine analyzer from records (scores) of past played chess games and a puzzle generator (program) that creates instructional puzzles from the information in the database. When a chess analyzer is fed the score (record) of one or more chess matches (games), it produces an output that typically includes, in addition to the game scores themselves (which include the individual game moves for both black and white), the numerical ranked score for each game move, the top ranked move for each game move (the move that the computer would have made in the same circumstance), the numerical ranked score of each such top ranked move, and the principal variation ("PV") for the game move (the top ranked move and all subsequent top ranked moves that the chess engine would have made in place of the game move).

A database constructed as described above can, upon proper inquiry, identify a plurality of played moves that all relate to a particular area of play. For example, the database could be asked to identify all moves from the various game scores that could have produced a mate within a given number of moves or less and failed to do so, or that failed to block mate by an opponent that could have, or were more than two points lower in score than the corresponding top ranked move. It will occur to those skilled in the art that the possible inquiries to the database to collect sets of game moves that reveal certain playing characteristics or shortcomings of a player that, if eliminated, would improve the player's level of play is limited only by the imagination of the programmer. By virtue of the present invention, the files of played game scores stored for players at playing web sites can be turned into valuable tools for gaining a keen insight to a player's abilities and the specific areas where improvements can be made. In addition, a database so constructed can supply sufficient information from which to create instructive puzzles by the puzzle generator of the invention to address those areas of exposed weakness where improvement is needed and possible.

In the preferred embodiment of the invention, the database supplied by the chess engine analyzer is expanded to include data in addition to that typically provided by a prior art analyzer in order to produce more sophisticated puzzles. Thus, in the preferred embodiment of the present invention, a chess engine that normally provides a standard chess game analysis (SCGA) database as described above is programmed to provide additional information and thereby produce an extended comparative game analysis database ("ECGA database"). The ECGA database is produced by programming a chess engine to provide such additional information as the identity of not only the top ranked move for every game move in a game score, but also a series of alternate, but lesser, ranked moves for each such game move, which moves are referred to herein as "alternative ranked moves". One way to identify alternative ranked moves is by instructing the chess engine analyzer to repeatedly apply the standard analysis to each game move with the instruction to the chess engine analyzer to successively eliminate from the possible results all top ranked moves previously identified by the engine for that game move. The engine analyzer is also programmed to provide the ranked score for each such alternative ranked move so identified. In another preferred embodiment of the invention, the chess engine analyzer is programmed to provide the alternative ranked moves for each top ranked move of a principal variation (PV) along with their ranked scores. A chess engine analyzer could be programmed to provide yet additional data, as will be apparent to those skilled in the art, without departing from the scope of the invention.

In one embodiment of the invention, a novel computer program ("Puzzle Generator") generates chess puzzles from the information in either a SCGA database or the ECGA database. Using the information available in either database, the Puzzle Generator creates instructional chess puzzles that form the basis of a highly sophisticated instruction program suitable for all players from beginners to masters. These instructional puzzles can then be presented to a player for solution and instruction. When the database is created from one or more game scores of the user, the puzzles created by the Puzzle Generator can provide instruction in those specific areas of the game where the database reveals that the user is in most need of improvement. In this way, the present invention is able to create and present to a user instructional chess puzzles that are specifically tailored to the particular needs of that user, regardless of the user's level of sophistication. The Puzzle Generator can be programmed in other ways to create and select puzzles that provide specific instruction based on a variety of criteria. In that regard, the puzzle-creating process is preceded by inquiries to the database to identify those game moves that have certain computer-identifiable characteristics such as those described above. Once these game moves are so identified, they can be used by the Puzzle Generator to create instructional puzzles.

Thus, the methods and apparatus of the present invention provide chess instructional material that is sophisticated, relevant to all levels of player ability and capable of creating and presenting instructional puzzles that are designed to address the specific playing characteristics of an individual user.

Accordingly, it is an object of the present invention to provide computer-generated instruction materials that are sophisticated, relevant to all levels of player ability and capable of creating and presenting instructional puzzles that are designed to address the specific playing characteristics of an individual user.

Another object of the invention is to provide a database of information from a chess engine analyzer which has been fed the game scores of a plurality of played chess games, including the moves made by both players of the games, which database can be queried to identify those moves that represent a particular characteristic of play (weakness or strength).

Another object of the present invention is to provide a database of information and a puzzle generator that constructs instructional puzzles from the database information.

It is another object of the present invention to provide an extended chess game analyzer (ECGA) database from which to create instructional puzzles.

Another object of the present invention is to provide an ECGA database that is created from a game record (or a portion or a plurality of game records) by a single player and create instructional puzzles from that database.

A further object of the present invention is to provide a web-based, non-downloadable program by which chess players can submit played games over the Internet and receive a series of instructional puzzles to be solved based on the players' own playing characteristics as demonstrated in the submitted games.

The invention possesses other objects and advantages, especially as concerns particular characteristics and features thereof which will be better understood from the following detailed description of the preferred embodiments when read in conjunction with the appended drawing figures.

BRIEF DESCRIPTION OF THE DRAWINGS

FIG. 4 is a sample PGN Game Record using standard chess notation;

FIG. 5 is an example of a printout of a portion of a PGN Game Record analyzed by a CRAFTY chess engine analyzer instructed to provide a standard chess game analysis (SCGA);

FIG. 6 is an example of a portion of a printout of a PGN Game Record analyzed by a CRAFTY chess engine analyzer instructed to provide an extended chess game analysis (SCGA);

FIG. 7 is another example of a portion of a printout of a PGN Game Record analyzed by a CRAFTY chess engine analyzer instructed to provide an extended chess game analysis (SCGA);

DETAILED DESCRIPTION OF THE INVENTION

Figure 1:
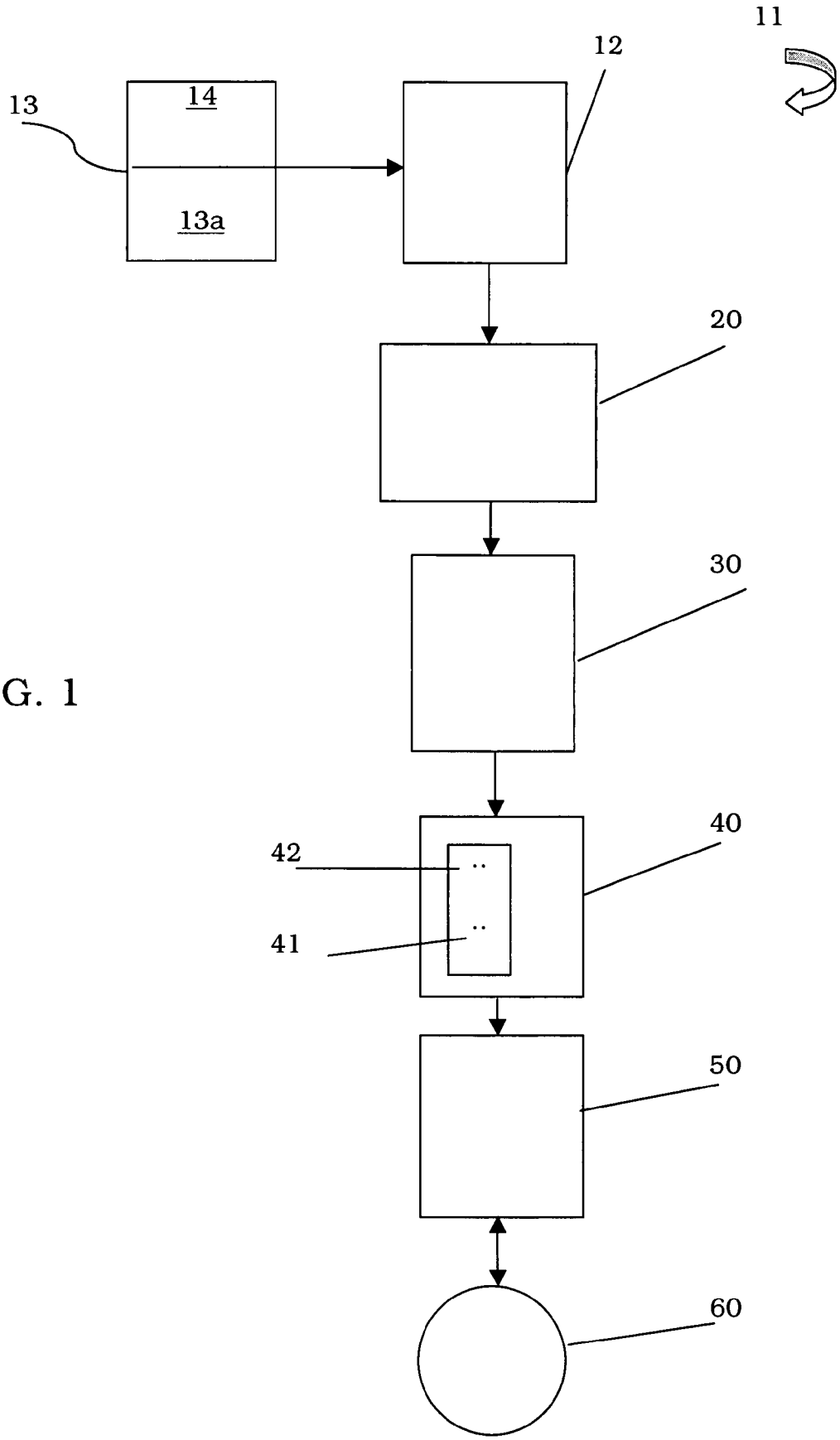
FIG. 1 is a flow diagram showing the system of the invention.

Referring to FIGS. 1-4, a system 11 of the present invention comprises a chess engine analyzer 12, such as CRAFTY, that can receive chess notation data 13 (game score or record) that comprise a record of chess moves 14 of a recorded chess game. As is customary in the art, the chess notation data 13 will include not only the recorded moves 14 made by the players during the game ("played moves" or "recorded moves"), but also identifying information 13*a*, such as the identities of the players, which pieces (black or white) they played, the date and location of the match, whether one side or the other has castled, etc. The sample PGN (Portable Game Notation) Game Record of FIG. 4 uses a universally recognized notation system that is understood by those familiar with the art of chess and therefore need not be further explained herein.

The data from analyzer 12 is recorded in various tables in database 20, as more fully described below. The database 20 supplies information to a puzzle generator 30 that creates instructional puzzles 41 having puzzle moves 42 that are recorded in a puzzle database 40 from which they can be displayed on an interactive display device 50 for solution by a player 60.

As is well known in the art and as illustrated in FIGS. 6 and 7, a score, is derived from the subsequent ranked moves that constitute the principal variation (PV) and not just a single move. Thus, to obtain a "score" for a move it is necessary to generate and consider the PV of that move. Thus, the score 16*s*, for example, is derived from the PV 17.

Figure 2:
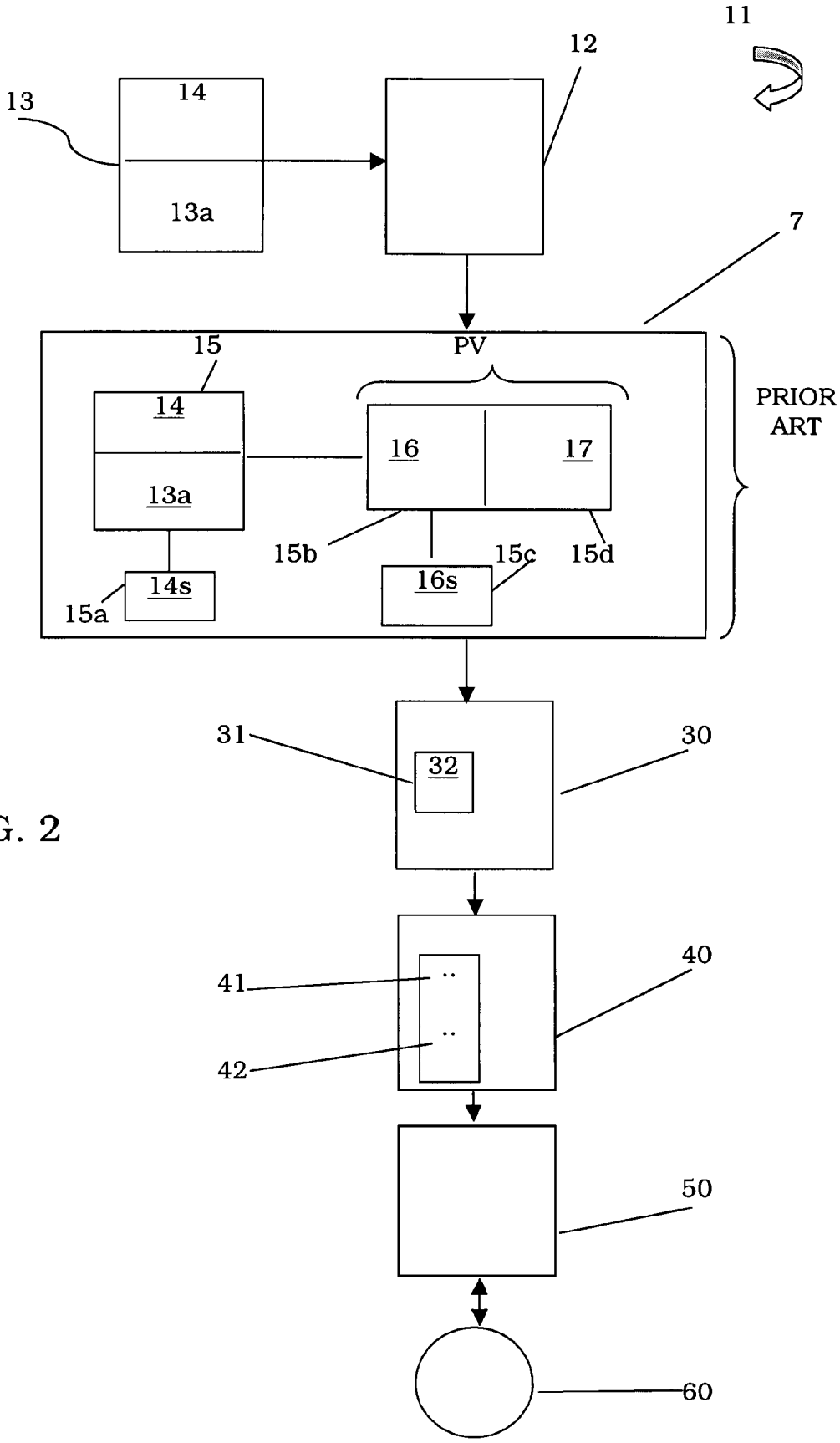
FIG. 2 is a flow diagram of the system of the invention similar to FIG. 1 having a prior art SCGA database.

Referring to FIG. 2, a chess game analyzer 12, such as CRAFTY, performs a standard comparative game analysis (SCGA) on the data 13 which produces four tables of data in addition to a game score table 15 that records game moves 14 and identifying information 13*a*. The four additional tables include: (1) a game move score table 15*a* that records the ranked scores 14*s* for each recorded game move 14 (referred to hereafter as "game move score"); (2) a top ranked move table 15*b* that records the top ranked move 16 that the chess engine analyzer 12 would have made from the same starting position as move 14 (referred to hereafter as "top ranked move for each game move"); (3) a top ranked moves score table 15*c* that records the scores 16*s* for moves 16 as determined by the engine analyzer 12 (referred to hereafter as "scores of top ranked game moves"); and (4) a table 15*d* that records the subsequent ranked moves 17 that the computer would have made after move 16 (referred to herein as "game move subsequent ranked moves").

The information in SCGA database 7 provides the following information for each game move 14 of a played game 13: (a) the move 16 that the chess engine analyzer 12 would have made in place of the move 14 (top ranked game move); (b) the subsequent ranked moves (game move subsequent ranked moves) 17 that the chess engine analyzer 12 would have played after move 16; (c) the score 16*s* of the top ranked move 16 (which is a function of PV 17); and (d) the ranked score 14*s* of game moves 14 ("game move scores"). This information is typically presented to a player in a printout (either in hard copy or digitally on a screen) having the format as illustrated in FIG. 5. Prior to the present invention, the only use made of this information was to present it to the player in the form of FIG. 5. For the first time, the present invention takes the information in a database, subjects it to further analysis (screening) and creates instructional puzzles 41 that can be tailored to a particular player to assist that player in improving his skill level.

While the data in the SCGA database 7 is sufficient for the puzzle generator 30 to create primitive instructional puzzles, as described above, in a preferred embodiment of the invention, the analysis performed by the chess engine analyzer 12 is expanded to create an extended chess game analysis (ECGA) in order for the system 11 to be able to create a more extensive database and there from more sophisticated puzzles 41. The ECGA database creates additional data tables from which a player 60 and the puzzle generator 30 can be more fully informed and from which sophisticated instructional puzzles 41 can be computer-generated.

Figure 3:
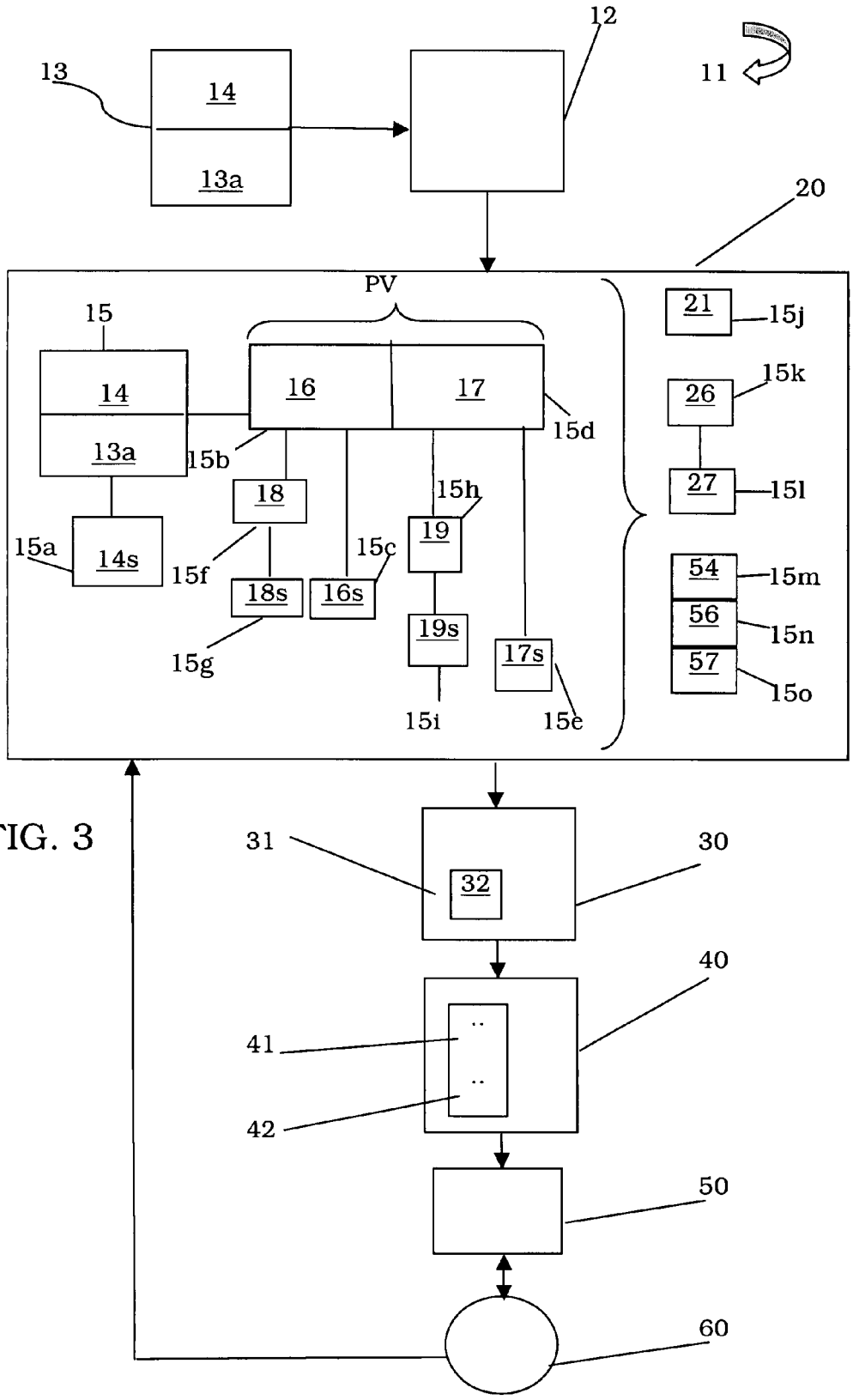
FIG. 3 is a flow diagram of the system of the invention similar to FIG. 1 having a novel ECGA database.

Referring to FIG. 3, in a preferred embodiment of the present invention, the chess engine analyzer 12 is programmed to receive a chess game record 13 (which may be a part of a game, an entire game and/or a plurality of games) and, from it, create an ECGA database 20 which, as described above, provides the data from which the puzzle generator 30 produces a database 40 of instructional puzzles 41 that are presented on an interactive display device 50 for solution by a player (user) 60.

In addition to the data tables 15-15*d* generated by the standard analysis of analyzer 12, an extended analysis is provided by chess engine analyzer 12 by being instructed to provide the following additional data in the following additional tables: (5) a subsequent ranked moves scores table 15*e* that records the scores 17*s* of the subsequent ranked moves 17 (referred to hereafter as "scores of game move subsequent ranked moves"); (6) an alternative ranked game moves table 15*f* that records alternative (lesser) ranked moves 18 for a game move 14 that lie below (scorewise) top ranked move 16 (referred to hereafter as "game move alternative ranked moves"); (7) an alternative ranked moves scores table 15*g* that records the ranked scores 18*s* for the alternative ranked moves 18 (referred to hereafter as "game move alternative ranked moves scores"); (8) a PV alternative ranked moves table 15*h* that records a plurality of alternative (lesser) ranked moves 19 for each move PV (subsequent ranked) move 17 (referred to hereafter as "alternative ranked moves of game move subsequent ranked moves"); and (9) a PV alternative ranked moves scores table 15*i* that records the scores 19*s* of the alternative ranked moves of PV moves 19 (referred to hereafter as "scores of alternative ranked moves of game move subsequent ranked moves"). In generating scores 19*s*, the PVs (subsequent ranked moves) of each of the alternative ranked moves of game move PV moves are also generated and are referred to hereafter as "subsequent ranked moves of the alternative ranked moves of game move PV moves".

The extended data tables described above add power to the system either all together or in various combinations.

Alternative ranked moves such as 18 can be identified by re-running the analysis for a recorded move 14 with the instruction to the analyzer 12 that each time cycled, the results not include any previously identified top ranked moves 16. Each time the analysis is performed, the alternative ranked move with the next highest score will be identified. In this way, the chess engine analyzer 12 provides for each recorded move 14 the top ranked move 16 and a series of alternative lesser ranked moves 18 having descending score values. The alternative ranked moves for PV moves 16 and 17 can be determined in the same way. Other ways may exist for determining alternative ranked moves which would be within the scope of the invention which is not dependant on how the alternative ranked moves are determined.

A further extension of information that is advantageously made available at ECGA database 20 is an accounting for all of the pieces on the board when a move 14 was made. This is referred to herein as a "count of material on the board" 26 and is recorded in a count of material on the board table 15*k* in database 20. A related datum is the relative strength of each side at the time a move 14 is made which is referred to herein as "count of the material balance white versus black" 27, which is recorded in count of the material balance white versus black table 15*l*. The database 20 can also include tables of any other useful information on each position at the time a game move 14 is made and the game as a whole.

FIG. 6 is a printout of a portion of database 20 wherein the engine was instructed to output N ranked moves for each game move 14. Thus, for each move 14 of white and each move 14 of black, the played move is noted along with its score. For move 50 for white, for example, the played move was g6 with a score of −7.96, while the top ranked move is Rd8+ with a score of +0.01. The second alternative ranked move (18) is Rel with a score (18*s*) of −4.62. According to PGN notation, White scores are based on a positive scale while Black scores are based on a negative scale.

FIG. 7 is a printout of a portion of database 20 containing the information in PV alternative ranked moves (19) table 15*h* and PV alternative ranked moves (19) scores (19*s*) table 15*i* which correspond to the information in FIG. 6.

An instructional puzzle 41 that was presented to a user 60 for solution can be identified as a "solved puzzle" 21 and recorded in a solved puzzles data table 15*j* in database 20 along with the move 14 on which the puzzle 41 was based and the steps taken by the user 60 using the interactive display device 50 to solve or attempt to solve the puzzle 41.

The data in tables 15*a*-15*l*, together or in various combinations, inform the ECGA database 20 with data from which puzzle candidate moves 32 can be selected from the table 15 (of recorded game moves 14) to form the basis of an instructional puzzle 41. For example, the tables 15*a*, 15*c* and 15*e* of scores 14*s*, 16*s*, and 18*s*, respectively, provide an objective scale 24 (not shown) against which the quality of the played move 14 can be compared. By way of illustration, the score 14*s* of the recorded move 14 might show, when compared to the scores 18*s* of the alternative (lesser) ranked moves, to be high on the list of ranked moves and thus a good (even if not the best) move, or it could show that the move 14 was low on the list and thus a poor move. As more fully explained below, scale 24 can be used (sometimes alone and sometimes along with other criteria) by the puzzle generator 30 to qualify moves 14 as sources of instructional puzzles 41.

The extended analyses performed by ECGA analyzer 12 described above are not meant to be exhaustive, as it will occur to those skilled in the art that the chess engine analyzers 12 can be programmed to create different tables of data in addition to those described above and further inform ECGA database 20.

The ECGA database 20 provides a rich source of data that can be mined by puzzle generator program 30 to create a puzzle database 40 of instructional puzzles 41. As more fully described below, in one embodiment of the invention, puzzle generator 30 creates a sub-set table 31 containing candidate moves 32 that are a sub-set of game moves 14 selected or qualified according to a set of criterion that can be set by a player 60 and/or programmed into the puzzle generator 30 as a default. The candidate moves 32 are those moves determined by the puzzle generator 30 (according to a set of criterion) to contain an instructional opportunity for the player 60.

Once a game move 14 is determined to be a candidate move 32 (moved into in sub-set table 31), the puzzle generator 30 determines if it is suitable as the basis of an instructive puzzle and, if so, creates one or more instructional puzzles 41 based on that candidate move 32. The instructional puzzles 41 are contained in a puzzle database 40 from which they can be presented for solution to a player 60 by way of an interactive display device 50, such as a computer, cell phone, handheld device, etc.

The first step in creating a puzzle is to set the criteria for selecting the recorded moves 14 of the played game or games that are candidates to be the basis of one or more instructional puzzles 41. It will occur to those skilled in the art that the criteria can be varied, depending on what the player 60 wants from the system 11. For example, either the SCGA database 7 or the ECGA database 20 can be queried for those game moves 14 that have a score 14*s* that is less than the score 16*s* of the corresponding top ranked move 16 by a set amount. Similarly, the database 20 can be queried to select those moves 14 for which there are a set number (2 or 3 for example) of better moves that could have been played based on the alternative lesser ranked moves tables 15*f* and 15*g*. As additional examples, database 20 can be queried to select those moves 14 that within a set number of moves could have prevented mate, or could have captured a queen, or could have obtained mate, or could have captured a major piece, or could have more effectively used a particular piece or any combination thereof, etc. By these or other criteria, a game move 14 for which there was a substantially better move become candidates for creating a puzzle 41. One of the outstanding features of the present invention is the ability of the system to sift through the data in the tables of database 20 and collect a set of moves that all pertain to a common theme or weakness or strength or the like and thereby inform a player about his/her game in a way not previously possible. To take advantage of this insightful information, the player can have instructional puzzles 41 tailor-made to the specific subject matter and presented for solution as a powerful learning experience.

One feature of a candidate move 32 that makes it suitable as an instructional puzzle 41 is that the PV for the candidate move 32 leads to a computer-discernable "event" within a reasonable number of moves. For example, where the game record 13 contains a move 14 that failed to recognize that the PV moves 16 and 17 under the same conditions would have resulted in mate in a small number of moves, the puzzle generator program 30 can be instructed to recognize that as an "event". One way that puzzle generator 30 can recognize an event that is not so clear-cut as a mate is to recognize when the scores 17*s* of the subsequent PV moves 17 become relatively constant after several changes, thereby indicating that an event has taken place. The several PV moves 17, along with the corresponding top ranked move 16 leading to the event, become the moves 42 of puzzle 41 that constitute the solution to the puzzle. Another event-indicating criterion can be gleaned from the information in tables 15*k* and 15*l* based on the count of material on the board and the material balance. When the count of material balance stops changing, that, too, signifies that an event has occurred. Because the criteria for qualifying game moves 14 as candidate moves 32 and for selecting candidate moves 32 as the basis for a puzzle 41 can vary greatly, the invention is not limited by any particular criterion and the criteria used herein to illustrate the invention are but examples and not a limitation of the invention. The invention of system 11 contemplates that the criteria for qualifying recorded moves 14 can be by way of built-in defaults or can be selected by the player 60 from a list of criteria offered to the player 60 in one of many ways known in the art such as by drop-down menus or the like.

Once one or more moves 14 are qualified as candidate moves 32 and moves 32 are selected as puzzles 41, the PV moves 16 and 17 of the selected move 32 are used to create computer-generated puzzles 41 that allow the player to replay a situation faced in an actual played game and learn how to make higher quality moves in that situation. The instructive puzzles 41 can range from one-move solutions to solutions requiring several moves.

A preferred method of the present invention comprises the steps of providing a database of information based on one or more chess scores and computer-generating instructional puzzles from the information available in the database. The method is particularly powerful as an instructional tool when the information in the database is based on a plurality (the more, the better) of game scores of one player.

In the method of one preferred embodiment of the invention, the database comprises the standard output of a chess engine analyzer (SCGA) from one or more game scores of the player. In another preferred embodiment, the output of the chess engine analyzer is extended (ECGA) beyond that presently offered by known chess engine analyzers.

The method of one preferred embodiment of the present invention for creating computer-generated chess puzzles 41 where the record 13 of one or more chess games (including the game moves 14) are recorded in a database 20 comprises:

(a) instructing a chess engine analyzer to give a ranked score (14*s*) for every legal move (14) for every position in a game record (score) (13) for Black and/or White;

(b) maintaining a table (15*a*) of these ranked scores (14*s*), along with a table (13*a*) of the position (piece locations, who is on move, is castling still legal, count of material on the board, count of the material balance white versus black, and any other useful information on each position, and the game as a whole);

(c) instructing the chess engine to obtain the top ranked move (16) for every legal move (14) for every position in a game record (score) (13) for Black and/or White;

(d) maintaining a table (15*b*) of the top ranked moves (16);

(e) instructing the chess engine to obtain the score (16*s*) for the top ranked move (16) for each game move (14);

(f) maintaining a table (15*c*) of the scores (16*s*) for the top ranked moves (16);

(g) instructing the chess engine to obtain the other principal variation (PV) moves (17) for the top ranked move (16) for each game move (14);

(h) maintaining a table (15*d*) of PV moves (17);

(i) creating a new game score by replacing each game move (14) with its PV moves (16 and 17);

(j) selecting for puzzles those game moves (14) that have PV moves (16 and 17) that lead to an event within Y moves;

(k) creating instructional puzzles (41) from the selected game moves (14).

In another embodiment, the method comprises:

(a) instructing a chess engine analyzer to give a ranked score (14*s*) for every legal move (14) for every position in a game record (score) (13) for Black and/or White;

(b) maintaining a table (15*a*) of these ranked scores (14*s*), along with a table (13*a*) of the position itself (piece locations, who is on move, is castling still legal)

(c) maintaining a table (15*k*), of the count of material on the board;

(d) maintaining a table (15*l*) of the count of the material balance white versus black, and any other useful information on each position, and the game as a whole);

(e) instructing the chess engine to obtain the top ranked move (16) for every legal move (14) for every position in a game record (score) (13) for Black and/or White;

(f) maintaining a table (15*b*) of the top ranked moves (16);

(g) instructing the chess engine to obtain the score (16*s*) for the top ranked move (16) for each game move (14);

(h) maintaining a table (15*c*) of the scores (16*s*) for the top ranked moves (16);

(i) selecting a sub-set of game moves (14) as puzzle candidate moves (32);

(j) maintaining a table (31) of puzzle candidate moves (32);

(k) instructing the chess engine to obtain the PV moves (17) following the top ranked move (16) for each puzzle candidate move (32);

(l) maintaining a table (15*d*) of PV moves (17);

(m) creating a new game score by replacing the game moves (14) for each candidate move (32) with its PV moves (16 and 17);

(n) selecting for instructional puzzles (41) those puzzle candidate moves (32) that have PV moves (16 and 17) that lead to an event within Y moves;

(o) creating an instructional puzzle (41) from the PV moves (16 and 17) of puzzle candidate moves selected in (n) above.

Step (g) of creating a sub-set 32 of moves 14 can be based on a number of different criterion. By way of example, from the tables of ranked scores (14*s* and 16*s*), qualify as candidate moves 32 any game move (14) having a ranked score (14*s*) that is less than the score (16*s*) of the top ranked move (16) by a margin X. Or from the table 15*f* of alternative game, ranked moves 18 select those game moves 14 that are X number of moves removed from the corresponding top ranked move 16. As another example, select those game moves 14 which could have prevented mate, but failed to do so. Other and more sophisticated criteria can be employed as will be recognized by those skilled in the art.

Once created, the instructional puzzles 41 are then presented to the player 60 on a display device 50 in much the same way as the authored puzzles are presented in the system described in U.S. Pat. No. 5,678,001. The primary difference is that in the prior art patented system, all of the puzzles and Information, Hints and Commentary are authored by one or more individuals independent of the playing level and style of the player using the system. In the present invention, the puzzles 41 are computer-generated from game scores 13 of actual played games that in the preferred case, will be a significant number of games played by the user (player) 60 of the system 11.

Figure 8:
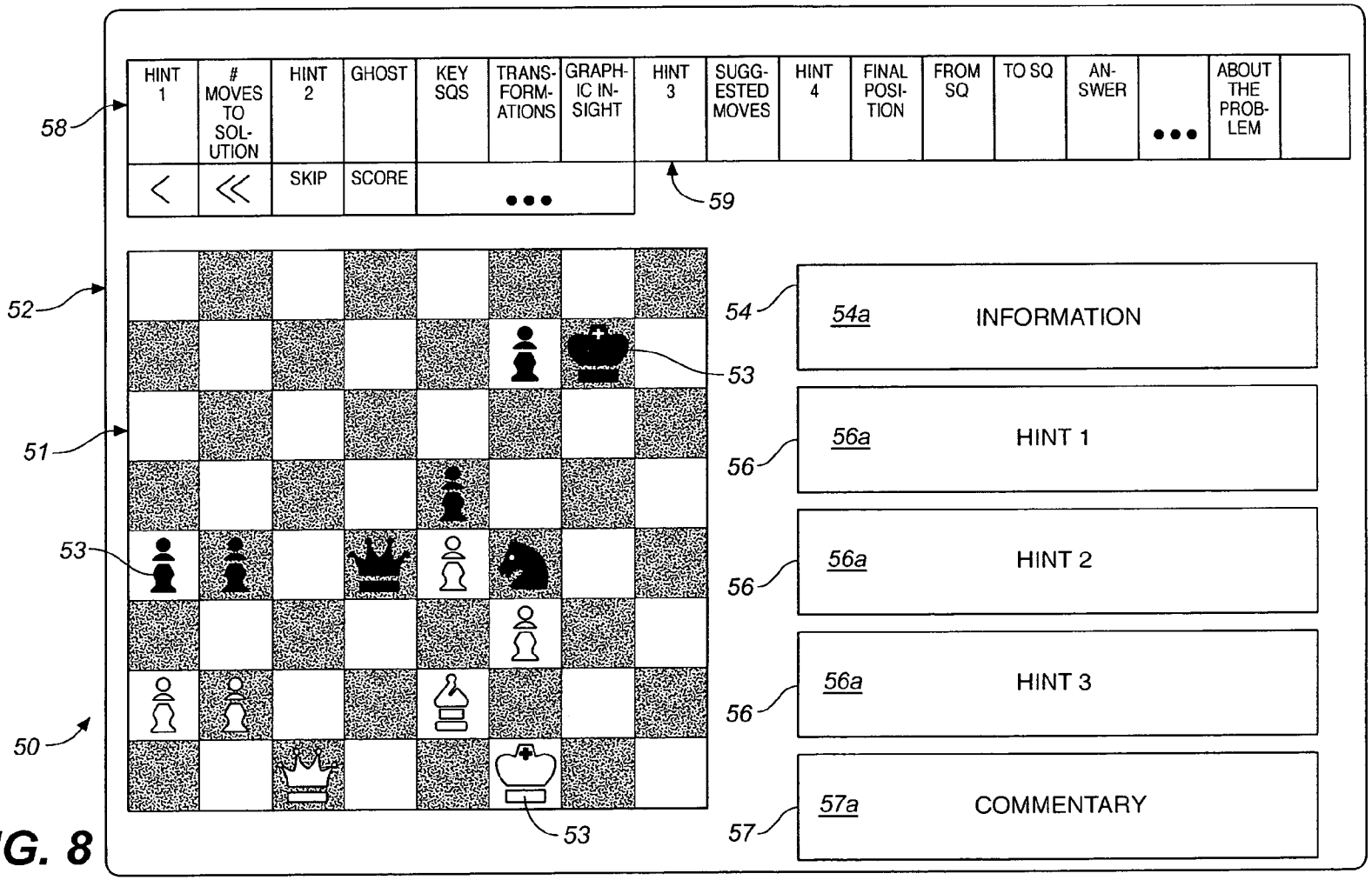
FIG. 8 is a representation of the screen of an interactive display device displaying the various elements of an instructional game puzzle of the present invention.

Referring to FIG. 8, a chess board representation 51 on a screen (GUI) 52 of the interactive display device 50 has representations of chess pieces 53 in the positions they occupied immediately prior to the candidate move 32 being made (the candidate move being the qualified move 14 on which the puzzle is based). The chess pieces 53 can be dragged and dropped onto other squares of board 51 according to the rules of chess in attempting a solution. The acceptable moves leading to the solution are the PV moves 16 and 17 that lead to the event that marks the solution to the puzzle 41. For each computer-generated puzzle 41, there are associated prompts labeled "Information" 54, "Hints" 56 and "Commentary" 57 which are made available to a user in screen fields 54*a*, 56*a*, and 57*a*, respectively.

Referring also to FIG. 3, the actual language of each Information message 54 is pre-programmed and stored in an Information table 15*m*; the actual language of each Hint 56 is pre-programmed and stored in a Hint table 15*n*; and the actual language of each Commentary 57 is pre-programmed and stored in a Commentary table 15*o*.

Typically, the prompt Information 54 will be revealed in field 54*a* without having to be selected and will typically provide basic information necessary to get started, but not directly relevant to the solution of the puzzle, such as, the player, whether it is Black or White, to move, and identifying the game from which the puzzle was created, etc. The Hint fields 56*a* can be "closed" (blank) and only reveal their contents (Hint 56) when selected (requested). There can be several Hints 56 and corresponding fields 56*a* allowing multiple Hints 56 to be on the screen simultaneously or there can be one field 56*a* which, each time selected, provides progressively more revealing Hints 56. Or the Hints can be selected from a list of offerings such as the examples below. Some Hints 56 are provided by information available from the tables 15-15*l* of ECGA database 20 and determined based on the position of the pieces on the board at the time the Hint 56 is requested. Or a Hint 56 may be of the pre-programmed variety from Hint table 15*n* based on the position of the pieces on the board relative to the solution moves. In either case, Hints 56 are computer-generated by the system 11 and may include, by way of example, answers to the following questions:

How many (more) moves to solution?

How much (more) material to be gained/saved by the best move?

What was the move made in the game?

How does the move I just tried rank in the order of ranked moves?

How did the prior move made by the opposition rank in the ranking of moves?

What piece type makes the next move of the solution?

It will occur to those skilled in the art that many more questions, the answers to which give information for solving a puzzle 41, could also be gleaned from the information available in database 20 for use as Hints 56. Pre-programmed Hints 56 can be offered without a question, as a response to a non-specified request for help in solving the puzzle.

The Commentary field 57*a* will typically be blank and reveal information in response to a move or when the final solution is reached.

The Commentary field could include such pre-programmed messages as:

"That was a very poor move, stay focused."

"You may want to get help from a Hint."

"Good job, you've solved the puzzle."

A particularly important Commentary 57 is:

"That was a good move, but not the best, try again."

This last commentary is particularly important to prevent giving misinformation to a player. For example, when, in the solution of a puzzle 41, the player 60 makes a move that is not a PV move 16 or 17 (and thus not a solution move), but from the alternative ranked moves of game move subsequent ranked moves table 15*h* or 15*i* (scores of alternative ranked moves of game move subsequent ranked moves), it is determined that the move made is nearly as good, the player 60 is alerted to this fact by this Commentary 57 in Commentary field 57*a*. Without the extended analysis that produces the data in table 15*i*, this Commentary would not be possible and a player would have no way of being informed that a rejected move was a good move even though not the move required to solve the puzzle 41.

It is within the scope of the invention to construct puzzles 41 having solution moves 42 that include not just PV moves 16 and 17, but also relatively high scoring alternative moves 18 or 19, so long as the branching that necessarily occurs is provided for in the data tables of database 20.

How, when, what and in what manner the Information 54, Hints 56, and Commentary 57 (and any other information otherwise classified or labeled) are used in connection with the solution of a puzzle 41 is a matter of choice and limited only by the creativity of the programmer and the data available in database 20.

One of the outstanding features of the present invention is that the messages contained in the Information 54, Hints 56 and Commentary 57 are all automatically generated from the database 20 and require no manual input or installation once the database 20 is programmed and instructed. The positions of chess pieces 53 on the puzzle chess board 51 at any given time are known by the system and either constitute a starting position (the position immediately prior to making the move 14 on which the puzzle is based), a position after a correct move in solving the puzzle (a PV position or other acceptable position), or a position after an incorrect move. Based on those possibilities and the data in tables 15-15*o*, the appropriate choice of Information 54, Hints 56 and Commentary 57 to be displayed in their corresponding fields 54*a*, 56*a* and 57*a* can be determined automatically by the system.

In addition to the representation of a chess board 51, chess pieces 53 and the Information field 54*a*, Hint fields 56*a* and Commentary field 57*a*, in the preferred embodiment, the computer screen (GUI) also presents a "tool bar" 58 comprised of a plurality of "tools" 59, each represented by a graphic or text icon. The tool bar 58 and its tools 59 provide a convenient way to prompt the interactive display device 50 to initiate subroutines that bring up Hints 56, as well as other information made self-evident by the labels of the tools 59.

Another feature of the invention is the ability of the player 60 to select instructions to be given to the database 20 for creating and presenting puzzles 41 whereby the player 60 can be in charge of what is presented as Information, what is only selectively revealed as a Hint and what information is given as Commentary. So, in essence, the player, by his/her past games 13 and input to the move selection process to identify the game moves 14 from which puzzles 41 will be constructed, and the instructions for making puzzles from the selected moves, creates his/her own lessons for becoming a better chess player. The outstanding feature of the present invention is that because it is so intimately tailored to the player, it is fun to use and effective in improving the player's play.

The steps taken by a user 60 in solving or attempting to solve a puzzle 41 can be recorded, stored in database 20 as table 15*j* (see FIG. 3) and used in the process of selecting played moves 14 from which to construct puzzles. For example, one of the criterion for selecting a move 14 to be a candidate move 32 could be that a puzzle 41 based on the same move 14 was not previously presented and successfully solved or was previously presented and not successfully solved, etc.

Figure 9:
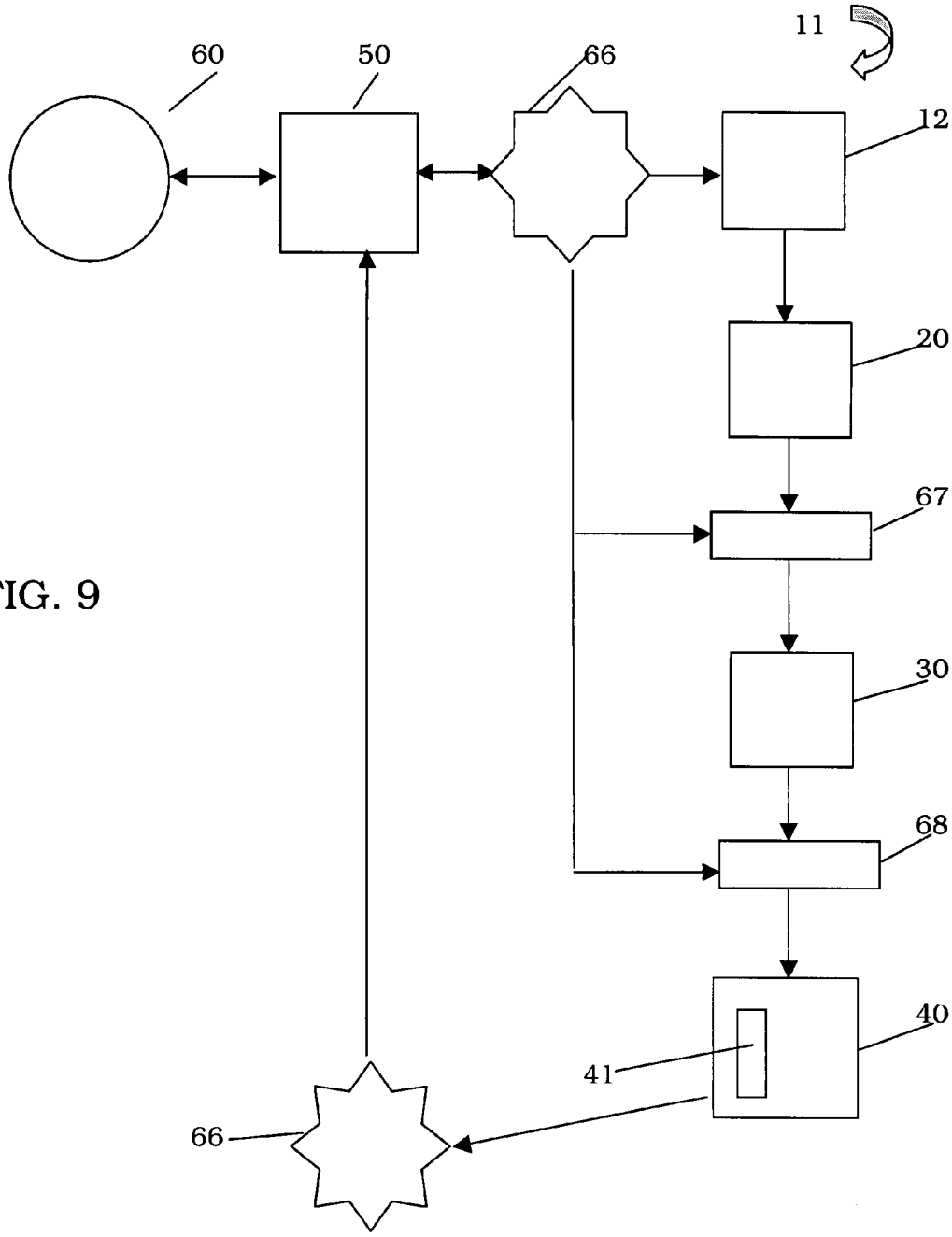
FIG. 9 is a flow diagram of an alternative embodiment of the invention in which access to the system is via the Internet.

Referring to FIG. 9, the system 11 of the present invention is accessed via the Internet 66. A user 60, using a computer 50 (which includes just about any interactive device having a screen that can access the Internet) having a connection to the Internet 66, uploads chess scores 13 of played games to the engine analyzer 12 hosted on a remote server (not shown). The instructional puzzles 41 generated by puzzle generator 30 (including Information 54, Hints 56 and Commentary 57) and stored in database 40 are presented to the player 60 on the computer 50 via the Internet 66. It will be obvious to those skilled in the art that the invention operates the same from the point of view of the player 60 whether the software program that runs the system 11 of the invention is resident on the user's computer 50 or on a remote server accessed via the Internet 66.

Shown diagrammatically in FIG. 9 are filters 67 and 68. These filters which are controlled by the user 60 via computer 50 and the Internet 66 are, in essence, instructions to the database 20 for selecting game moves 14 as candidate moves 32 and candidate moves 32 as puzzles 41. As mentioned above, those two steps can be combined into one. The player 60 is presented with a menu of choices at computer 50 from which to select to set the criteria which constitute the filters 67 and 68. This feature of the invention is applicable to the embodiment where the invention previously described where the software is resident on the computer 50.

While the invention has been described using a chess engine as the source of the database from which puzzles are constructed, it will be obvious to those skilled in the art that a database otherwise constructed could also supply the needed information to serve the purposes of the invention.

It will also be apparent to those skilled in the art that the principles of the invention illustrated with reference to the game of chess are equally applicable to other games of skill including such games as Go, Backgammon, Poker, and the like.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A method of computer-generating instructional chess puzzles from game moves from one or more chess games recorded in a database comprising:

(a) instructing a chess engine analyzer to give a ranked score for each game move and maintain said ranked scores in a table in the database;

(b) instructing a chess engine analyzer to obtain the top ranked move for each game move and maintain said top ranked moves in a table in the database;

(c) instructing the chess engine analyzer to obtain the score for the top ranked move for each game move and maintain said scores in a table in the database;

(d) instructing the chess engine to obtain the subsequent ranked moves for the top ranked move for each game move and maintain a table of such subsequent ranked moves in a table in the database;

(e) instructing the chess engine analyzer to obtain a score for the subsequent ranked moves and maintain said scores in a table in the database;

(f) instructing the chess engine analyzer to obtain alternative ranked moves of game move subsequent ranked moves and maintain a table of such alternative ranked moves in the database;

(g) instructing the chess engine analyzer to obtain a score for the alternative ranked moves of game move subsequent ranked moves and maintain a table of such scores in the database;

(h) computer-generating instructional puzzles from information in the database including the tables created by instructing the chess analyzer according to (f) and (g) above.

2. The method of claim 1 further comprising:

selecting for instructional puzzles those game moves that have subsequent ranked moves that lead to an event within a plurality of moves.

3. The method of claim 1 further comprising:

selecting a sub-set of game moves as candidate instructional puzzle moves; and selecting from the sub-set of such game moves those game moves that have subsequent ranked moves that leads to an event within a plurality of moves.

4. The method of claim 1 further comprising:

providing accessible commentary relative to the solution of an instructional puzzle from information in the database including the tables created by instructing the chess analyzer according to (f) and (g) above.

5. A computer-executed method of creating instructional chess puzzles from one or more chess game records, comprising:

creating a database of information from the chess game records of one or more chess games using a chess engine analyzer program;

generating instructional chess puzzles from the information in said database wherein said puzzles have a starting position of a plurality of chess pieces on a chess board that constitutes the beginning of the puzzle and a final position of chess pieces on the board that constitutes the solution to said puzzle which solution is achieved by making a plurality of correct chess piece moves, wherein said chess game records include game moves and said database of information created from the game records includes game moves and (a) game move scores, (b) the top ranked move for each game move, (c) scores of top ranked moves, (d) game move subsequent ranked moves, (e) scores of game move subsequent ranked moves, (f) game move alternative ranked moves, (g) scores of game move alternative ranked moves, (h) alternative ranked moves of game move subsequent ranked moves and (i) scores of alternative ranked moves of game move subsequent ranked moves; and providing accessible commentary relative to the solution of a puzzle from information in said database including (e) scores of game move subsequent ranked moves, (h) alternative ranked moves of game move subsequent ranked moves and (i) scores of alternative ranked moves of game move subsequent ranked moves.

6. In a chess instructional system for creating interactive chess puzzles for display on a display device, the combination comprising:

a chess engine analyzer program residing on a non-transitory computer readable medium that operates with a computer to create a searchable database of information from one or more chess game records wherein said searchable database includes: game records of game moves and (a) game move scores, (b) the top ranked move for each game move, (c) scores of top ranked moves, (d) game move subsequent ranked moves, (e) scores of game move subsequent ranked moves, (f) game move alternative ranked moves, (g) scores of game move alternative ranked moves, (h) alternative ranked moves of game move subsequent ranked moves and (i) scores of alternative ranked moves of game move subsequent ranked moves;

a puzzle generator program that causes a computer to create instructional chess puzzles created from said database information wherein said instructional puzzles have a starting position of a plurality of chess pieces on a chess board and a final position of chess pieces on the board that constitutes the solution to said puzzle, which solution is achieved by making a plurality of correct chess piece moves; wherein said puzzle generator program further causes said computer to create accessible commentary relative to the solution of a puzzle from information in said database including: (e) scores of game move subsequent ranked moves; (h) alternative ranked moves of game move subsequent ranked moves and (i); scores of alternative ranked moves of game move subsequent ranked moves.

7. A computer program residing on a non-transitory computer readable medium operable with a computer having a display device to cause the computer to create and display interactive instructional chess puzzles on the display device as follows:

cause the computer to act as a chess engine analyzer;

create a database of information from chess moves of chess game records of one or more chess games wherein the database of information includes game moves from game records, and (a) game move scores, (b) the top ranked move for each game move, (c) scores of top ranked moves, (d) game move subsequent ranked moves, (e) scores of game move subsequent ranked moves, (f) game move alternative ranked moves, (g) scores of game move alternative ranked moves, (h) alternative ranked moves of game move subsequent ranked moves and (i) scores of alternative ranked moves of game move subsequent ranked moves;

generate interactive instructional chess puzzles from the information in the database wherein the puzzles have a starting position of a plurality of chess pieces on a chess board and a final position of chess pieces on the board that constitutes the solution to the puzzle, which solution is achieved by making a plurality of correct chess piece moves, and cause the computer to provide accessible commentary relative to the solution of a interactive instructional chess puzzle from information in the database including (e) scores of game move subsequent ranked moves, (h) alternative ranked moves of game move subsequent ranked moves and (i) scores of alternative ranked moves of game move subsequent ranked moves.

* * * * *